US007735611B2

(12) United States Patent
Tyni

(10) Patent No.: US 7,735,611 B2
(45) Date of Patent: Jun. 15, 2010

(54) IDENTIFICATION OF INCOMING PEAK TRAFFIC

(75) Inventor: Tapio Tyni, Hyvinkää (FI)

(73) Assignee: Kone Corporation, Helsinki (FI)

( * ) Notice: Subject to any disclaimer, the term of this patent is extended or adjusted under 35 U.S.C. 154(b) by 848 days.

(21) Appl. No.: 10/553,054

(22) PCT Filed: Apr. 15, 2004

(86) PCT No.: PCT/FI2004/000232

§ 371 (c)(1),
(2), (4) Date: Dec. 18, 2006

(87) PCT Pub. No.: WO2005/000726

PCT Pub. Date: Jan. 6, 2005

(65) Prior Publication Data

US 2007/0084674 A1 Apr. 19, 2007

(30) Foreign Application Priority Data

Jun. 30, 2003 (FI) ..... 20030972

(51) Int. Cl.
*B66B 1/20* (2006.01)

(52) U.S. Cl. ..... 187/386; 187/392; 187/387

(58) Field of Classification Search ..... 187/380–382, 187/385–387, 391, 392
See application file for complete search history.

(56) References Cited

U.S. PATENT DOCUMENTS 3,967,702 A * 7/1976 Iwaska et al. ..... 187/387
3,973,649 A * 8/1976 Iwasaka et al. ..... 187/387
4,044,860 A * 8/1977 Kaneko et al. ..... 187/392
5,229,559 A * 7/1993 Siikonen et al. ..... 187/391
5,260,526 A * 11/1993 Sirag, Jr. ..... 187/387
5,260,527 A * 11/1993 Sirag, Jr. ..... 187/392
5,274,202 A * 12/1993 Kezer et al. ..... 187/385
5,276,295 A * 1/1994 Kameli ..... 187/385
5,511,635 A * 4/1996 Kameli ..... 187/392
5,544,059 A * 8/1996 Hikita et al. ..... 701/117
5,679,932 A * 10/1997 Kim ..... 187/382
6,257,373 B1 * 7/2001 Hikita et al. ..... 187/392
6,401,874 B2 * 6/2002 Siikonen ..... 187/382
2009/0133968 A1 * 5/2009 Smith et al. ..... 187/382

FOREIGN PATENT DOCUMENTS

EP 0 427 992 A2 5/1991
EP 0 739 848 A2 10/1996

* cited by examiner

*Primary Examiner*—Walter Benson
*Assistant Examiner*—Eduardo Colon-Santana
(74) *Attorney, Agent, or Firm*—Birch, Stewart, Kolasch & Birch, LLP.

(57) ABSTRACT

A method and system for effectively identifying an incoming peak traffic situation in an elevator system is provided. To allow faster detection of a peak traffic condition, use is made of both information obtained from traditional peak hour identification and history data obtained from statistics regarding the numbers of passengers. Traditional peak hour identification monitors the car weight and the number of calls in real time. Statistics provide information regarding typical rush hours in the building. In the method of the present invention, the number of passengers gathering on the lobby floor is forecast on the basis of statistics at the moment when the next elevator is at the lobby floor, ready to take in passengers. When the forecast number of passengers exceeds the car load threshold value for traditional peak hour identification, an incoming peak traffic mode can be activated reliably already on the basis of a single peak elevator.

27 Claims, 3 Drawing Sheets

IDENTIFICATION OF INCOMING PEAK TRAFFIC

FIELD OF THE INVENTION

Figure 1:
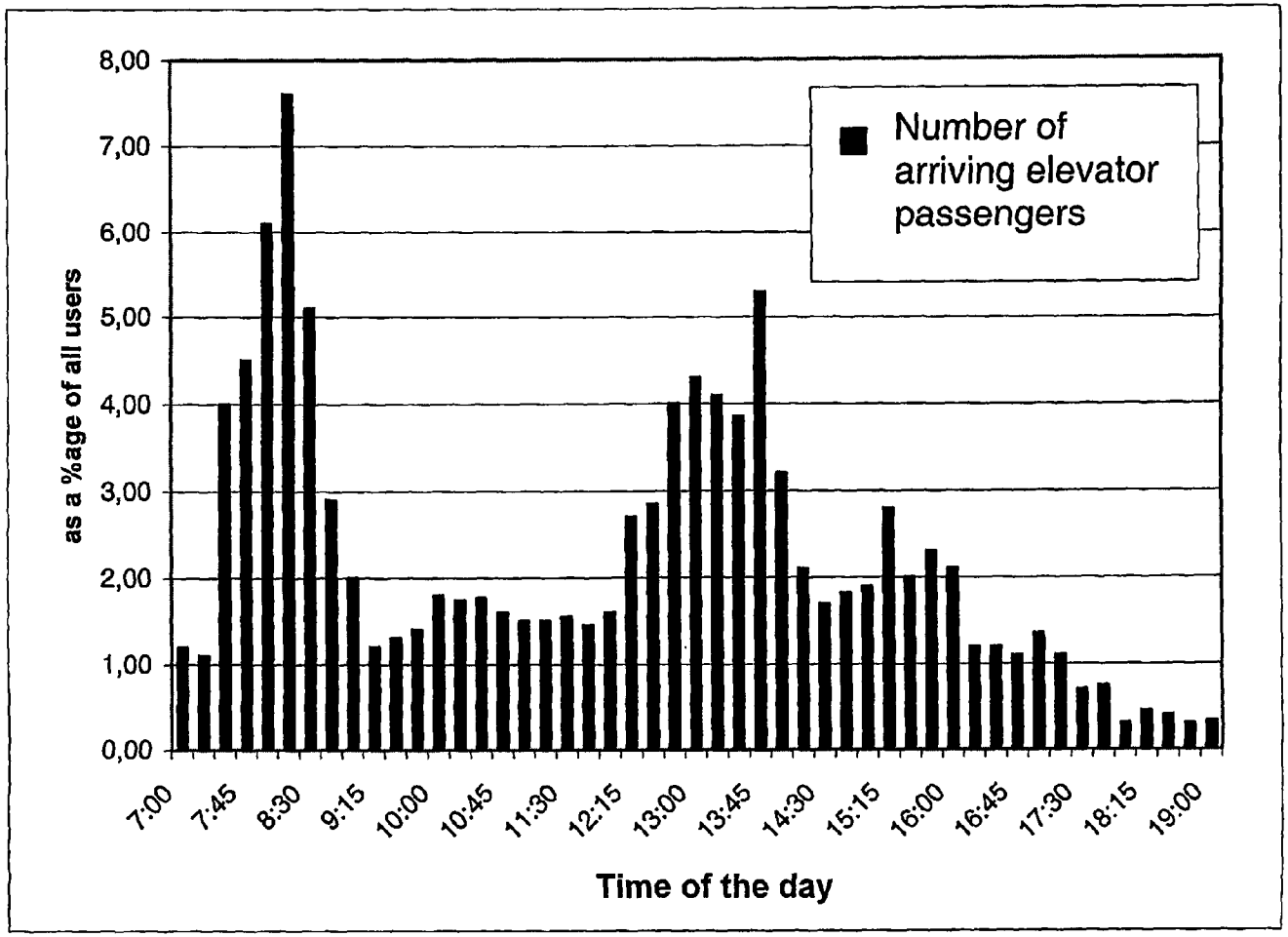

The present invention relates to the control of an elevator group.

BACKGROUND OF THE INVENTION

When a passenger wishes to travel by elevator, he/she calls an elevator by pressing a landing call button installed at the floor. The control system of the elevator receives the call and tries to determine which one of the elevators in the elevator group is best able to serve the person having issued the call. This activity is call allocation. The problem to be solved by allocation is to select for each call an elevator that will minimize a preselected cost function.

The elevator group control system is typically configured to control the elevators in accordance with preselected control algorithms. The control algorithm selected depends on the traffic type prevailing in the building at the time. Therefore, the elevator group control system often comprises a traffic type detector. The traffic types identified by a basic traffic type detector are e.g. "normal traffic", "incoming peak traffic", "outgoing peak traffic" and "two-way peak traffic". Fast and reliable detection of an incoming peak traffic condition is particularly important. In office buildings, incoming peak traffic conditions may arise in the morning during a few minutes as people arrive at their jobs within a short time. An example of typical incoming traffic in an office building is presented in FIG. 1.

During incoming peak traffic, the primary function to be fulfilled by the group control system is to return elevators to the entrance floors in a suitable proportion. If in normal-traffic operating mode one elevator is returned for each call issued, then in incoming peak-traffic conditions elevators are returned directly to the entrance floors without a separate call until the system establishes that the peak traffic condition has ceased to exist. The operation of the system can not be influenced by allocation decisions made on the basis of landing calls, because on the entrance floors typically only one landing call, usually an up call, is valid. If direct return of elevators were not activated during incoming peak traffic, there would arise a situation where only two elevators for each entrance floor would be operating; one loaded with passengers and delivering them to their destination floors and another empty and returning to the entrance floor on the basis of a call issued from there. If incoming peak traffic is not identified quickly, long queues will build up in the lobby or in general on the entrance floor of the building and passenger waiting times will become longer. Long waiting times may cause dissatisfaction with the operation of the elevators.

On the other hand, the incoming peak mode should not be activated unnecessarily because direct return of elevators to the entrance floors is a strong measure and its uncalled-for activation will significantly interfere with the rest of elevator service in the building. In that case, calls issued from floors other than the entrance floors are obviously served more slowly than during normal traffic. The algorithm controlling the return of the elevators must be so designed that, during a long-lasting incoming peak traffic situation, calls issued from other floors will be served, although with a delay. Identification of an incoming peak traffic condition involves two partially contrary objectives. The identification must work as fast as possible, but it must not produce incorrect identification results.

In traditional identification of incoming peak traffic, the number of calls is monitored as passengers are entering an elevator in a lobby area (in this case, this comprises each entrance floor of the building). Among the calls, expressly the number of calls with a destination outside the lobby area are considered. When the number of calls exceeds a preset threshold value, the elevator in question is interpreted as a peak elevator and the situation as a potential incoming peak traffic condition.

A threshold value of a corresponding type is also set for the car load. When the elevator leaves the lobby area and its load exceeds the threshold value, the elevator is interpreted as a peak elevator and the situation as a potential incoming peak traffic condition. When two or more peak elevators are detected within a given time window, an incoming peak traffic mode is activated, which in turn starts direct return of elevators to the entrance floors. Two peak elevators at a given predetermined time are required to ensure that peak hour identification will not occur unnecessarily on the basis of occasional peak elevators outside actual peak traffic hours. On the other hand, this retards the identification of a real peak traffic situation at the early stage of a real peak traffic condition.

During actual peak traffic hours, it would be advantageous if the incoming peak traffic mode could be activated already on the basis of a single peak elevator identified. For this purpose, it is possible to set in the control system two separate time windows, typically for morning and lunch-time peak hours, during which the identification of a single peak elevator is sufficient for the activation of the incoming peak traffic mode. A problem with this solution is that it involves the necessity to know the building and its users' times of elevator utilization well enough to allow the aforesaid time windows to be set at the most probable times of beginning of peak traffic conditions. In addition, there should preferably be a possibility to set the time windows separately for each day of the week because the usage profile of the elevators of the building is typically different during the weekend as compared with weekdays. Weekdays again are mutually very similar to each other. However, in practice it is not possible to set the time windows separately for each day of the week because the control logic of the elevator system typically only allows two fixed time windows to be set.

Traffic Forecaster-based identification of peak traffic conditions (TF) calculates the numbers of passengers arriving to and leaving each floor of the building and maintains statistics of these numbers. The calculation is done during the time when the elevator is standing at the floor while passengers are leaving and entering the car. The calculation is based on the use of a car load weighing device and a light cell provided in the elevator door.

TF-based peak hour identification collects statistics of two different types: Long Term Statistics (LTS) and Short Term Statistics (STS). The unit measure used in LTS statistics is e.g. "number of passengers in 15 minutes" and in STS statistics "number of passengers in 5 minutes". LTS statistics are generated for each floor i. For each floor there are four traffic components k: passengers arriving to the floor from below, passengers arriving to the floor from above, passengers leaving the floor in the downward direction and passengers leaving the floor in the upward direction. In LTS statistics, the day is divided into 96 time slices t of 15 minutes each: the first slice covers the time from 00:00 to 00:15, the next from 00:15 to 00:30 and the last slice from 23:45 to 00:00. Thus, LTS statistics is a three-dimensional matrix $L_{i,k,t}$. During the day, the passengers are collected into daily statistics $L_{i,k,t}^*$. At midnight, the collected diurnal statistics are subjected to statistical approval tests to ensure that the day collected is not e.g. a midweek holiday. If the diurnal statistics pass the approval tests, then the LTS statistics will be updated e.g. as follows:

$$L_{i,k,t}=(1-\alpha)\cdot L_{i,k,t}+\alpha\cdot L_{i,k,t}^{*}, \quad (1)$$

where $\alpha$ is an update factor ($0<\alpha<1$). The selected $\alpha$-value is generally small (0.1 . . . 0.2). With typical $\alpha$ values, the method preserves most of the old data and adds some new data. Depending on the school, this up-dating method is called exponential equalization or linear IIR (IIR, Infinite Impulse Response) low-pass filtering. Equation (1) yields a floating average of traffic component k for floor i of the building during time slice t. It describes a past situation, in other words, it gives the average number of passengers having moved before on floor i during the time slice t in question.

The floors comprised in the lobby area of the building being known, it is possible to produce from LTS statistics a traffic profile as shown in FIG. 1. By proportioning the traffic components to the calculated transport capacity of the elevator group and using fuzzy logic, it is possible to identify different traffic types even with very fine distinctions. U.S. Pat. No. 5,229,559 describes a method of this type for determining the traffic type on the basis of statistical data. In practice, however, LTS statistics cannot be used directly for determining the traffic type prevailing in a building because LTS statistics represent a long-term average of traffic observed in the building in the past. What is actually going on in the building at the moment under consideration may differ widely from the long-term average. Therefore, the traffic type obtained from LTS statistics should be interpreted as indicating the traffic type that typically prevails in the building at each instant of time.

In an attempt to solve the above-mentioned problem, short-term STS statistics have been introduced. STS statistics differ from LTS statistics in that they form a two-dimensional matrix $S_{i,k}$, where i represents the floor and k the traffic component. The time index t is missing because the number of passengers is calculated and included in STS statistics in a floating manner for the time of five minutes preceding the current instant. In other words, passengers having used the elevator over five minutes ago are removed from the statistics. To identify the traffic type currently prevailing in the building, STS statistics are subjected to the same aforementioned fuzzy logic deduction procedure as LTS statistics.

After this, the information contained in the LTS and STS statistics are combined via a fairly complicated chain of inferences. In this connection, the traffic types given by the statistics are compared to each other, the traffic intensities measured by STS are compared to the transport capacity of the system and the LTS statistics are utilized to obtain confirmation of the traffic type given by the STS statistics.

There are two problems of principle associated with this method. First, LTS and STS statistics are not mutually comparable because the length of the period under consideration is not the same: typically 15 minutes in LTS and 5 minutes in STS. In addition, the time slices in LTS statistics are stationary and have a permanent length of 15 minutes, whereas in STS statistics the time window floats steplessly over the entire diurnal cycle. Second, particularly in view of incoming peak traffic, the five-minute time window of STS statistics is still too long to be used for the activation of an incoming peak mode.

A third problem is associated with practical implementation. The complicated deduction procedure for combining the traffic types produced by STS and LTS require many threshold values to be separately adjusted. Also, trimming and testing the set of rules themselves is a laborious task.

OBJECT OF THE INVENTION

The object of the present invention is to overcome the above-mentioned drawbacks or at least to significantly alleviate them. A specific object of the invention is to achieve faster and more reliable identification of an incoming peak traffic condition than before. As for the features of the invention, reference is made to the claims.

BRIEF DESCRIPTION OF THE INVENTION

The present invention discloses a method, a computer program product and a system for the identification of an incoming peak traffic condition in an elevator system.

The present invention combines information obtained from statistics with real-time information obtained from traditional peak hour identification. LTS (Long Term Statistics) statistical data collected over a long time span chart the passenger flows observed at different times of the day in the elevators of the building under consideration. Typically, queues build up on the lobby floors in the morning and around the end of the lunch break. From the statistics it is possible to distinguish the most probable times when congestion begins to develop on the lobby floors. In traditional elevator control, a call given by pressing a call button is served by one elevator, which remains stationary after the trip, waiting for the next call. This method works clumsily in a peak traffic situation. The service is slow and the customers are dissatisfied. There is a need to develop an algorithm that would allow faster detection of an incoming peak traffic condition and permit direct return of the elevators to the lobby floors to be activated without a separate press on a call button.

By using the present invention, it is possible to achieve faster identification of an incoming peak traffic condition. In an embodiment of the invention, statistics are utilized to determine the potential peak times when the lobby floors are typically congested. At the same time, the elevators in the elevator system are observed in real time via traditional monitoring of car calls and car load, and when a given threshold value is exceeded, the elevator is assigned a peak elevator status. Threshold value refers e.g. to the total weight or number of the elevator passengers. In addition, in this embodiment, one peak elevator is already sufficient to activate the incoming peak traffic mode, i.e. direct return of the elevators.

In another embodiment of the invention, the number of passengers gathered on the lobby floor is forecast by utilizing statistics and a theoretical so-called time interval between the times when elevators leave the lobby floor. If the number of customers given by the forecast exceeds the car load threshold value for traditional peak hour identification, the situation is considered as a potential peak time, in which situation even one peak elevator detected is sufficient to activate direct return of the elevators.

As an extension of the basic idea of the invention, it is also possible to include in the forecast the time windows preceding the time window for the moment under consideration and/or the time window following it. In this case, the method in a way takes a "lookahead" into the future and accelerates the identification of an incoming peak traffic condition when it is known on the basis of statistics that a peak time is just beginning.

The present invention has several advantages as compared with prior art. Fast identification of an incoming peak traffic condition is achieved, as a consequence of which, the incoming peak traffic mode being activated at the beginning of the peak time, the queues in the lobbies are shorter as compared with traditional peak hour identification. In this way, better service is provided and passengers are kept more satisfied. During statistically recorded peak hours, the system identifies a peak traffic condition already on the basis of a single peak elevator. In the most favorable case, the incoming peak traffic mode can be activated via inferences made from a large number of car calls even while the first peak elevator is only just being loaded at a lobby floor.

A second significant advantage of the present invention is that reliable identification of an incoming peak traffic condition is achieved. The system also identifies an "unexpected" peak traffic condition within a reasonable time on the basis of two peak elevators outside statistically unrecorded peak hours. After the initial start-up (during about a few weeks), the elevator system is not able to utilize LTS statistics because the system has not yet been in operation long enough to allow collection of statistics. In this case, optimal peak hour identification is achieved without help from statistics on the traditional principle whereby peak hour identification is only activated after two peak elevators have been detected.

A third advantage of the invention is that the function can be automated. The statistics collected are day-specific and the statistically recorded traffic profiles especially for weekends differ clearly from the corresponding profiles for weekdays. If the potential peak hours have been set manually, they are valid on every day of the week during the same times of the day and they cannot be modified to make them day-specific. This is naturally a definite disadvantage. In addition, typically a maximum of only two manually set potential peak times can be set for the diurnal cycle. Statistics again may in principle contain an unlimited number of potential peak times. Moreover, an automated identification function involves a great advantage of adaptability related to usability. If significant changes occur in the traffic situation in the building, these changes will appear before long in the LTS statistics and thus peak hour identification is always adapted to the prevailing passenger behavior. Furthermore, the delivery of an elevator system to a client is simplified by the fact that, using the new peak hour identification method, two parameters to be configured at delivery time or on site can be discarded.

LIST OF FIGURES

Figure 2:
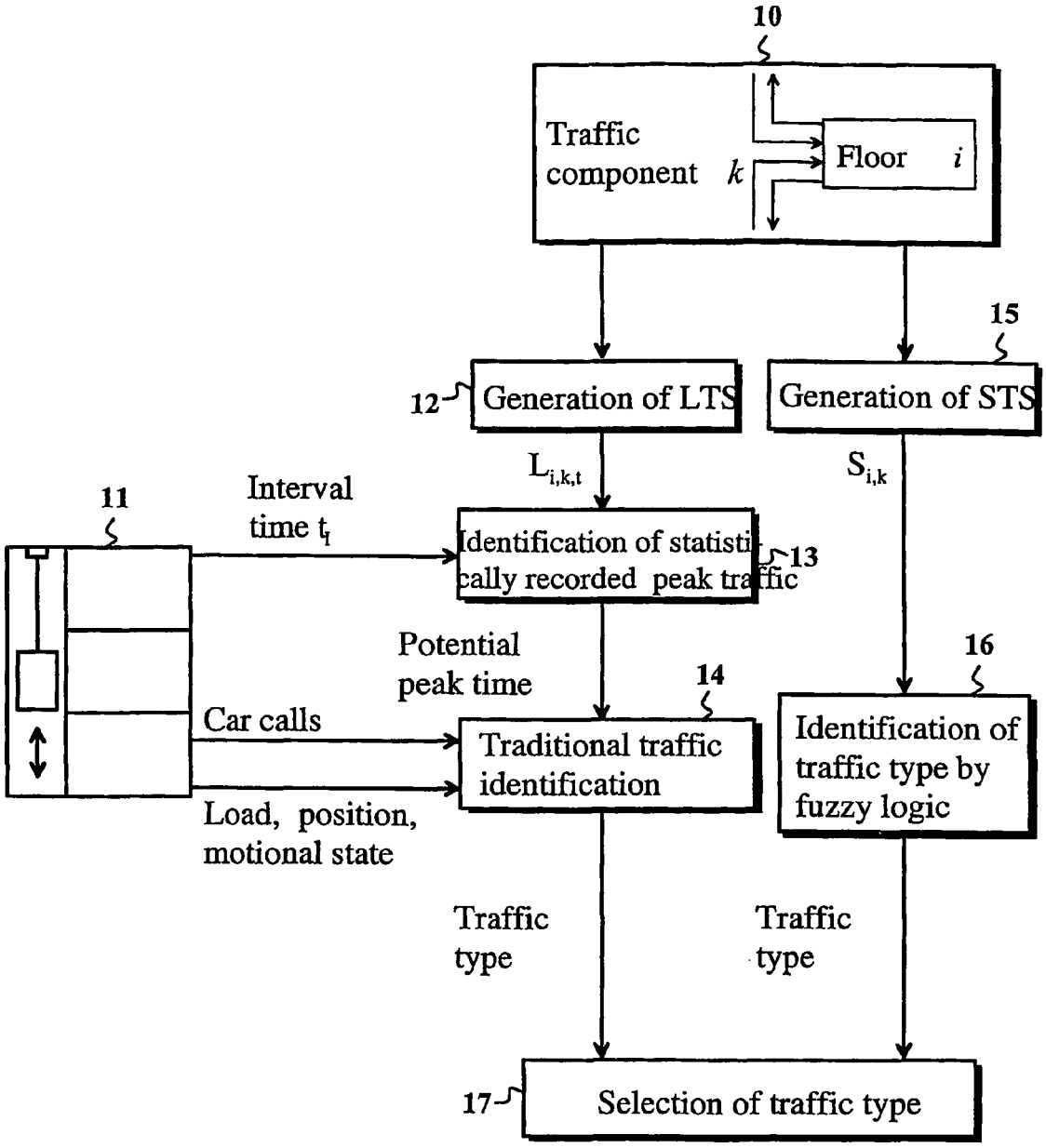
Figure 3:
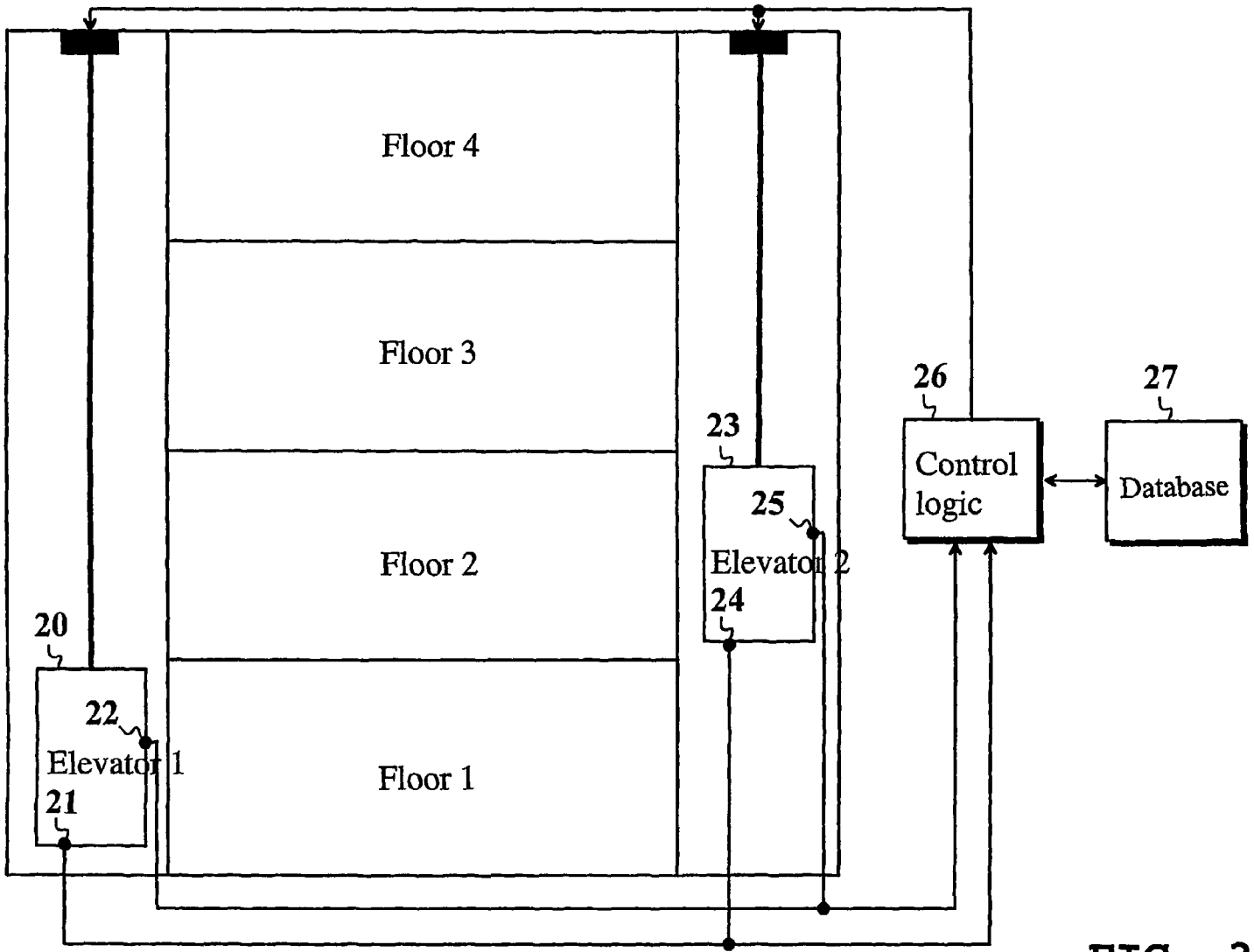

FIG. 1 presents an example of a typical incoming traffic situation in an office building, FIG. 2 presents a block diagram representing the method of the present invention, and FIG. 3 presents an example of a system where the method of the present invention is used.

DETAILED DESCRIPTION OF THE INVENTION

FIG. 2 presents a flowchart representing the operation of the method of the present invention. In traditional peak hour identification 14, peak elevators can be quickly and reliably detected by means of detectors. 'Detectors' refer either to the car load weighing device or the elevator light cell or both. In the most favorable case, a peak elevator is detected on the basis of the number of car calls 11 while the elevator is still taking in passengers. When two peak elevators are detected within a given time window, an incoming peak traffic mode 17 is activated. However, traditional identification works better if it receives advance information regarding potential peak times. The traffic behavior of the building and the people traveling in it being known, it has often been possible to input the peak times to the control system manually on site. On the other hand, the TF (Traffic Forecaster) statistics and LTS statistics (Long Term Statistics) 12 contain this very information needed by the traditional peak hour identification 14. The traditional peak hour identification system detects what is currently occurring in the building, while the TF and LTS statistics reveal what generally occurs in the building at this time.

In an embodiment of FIG. 2, if the traffic type given by the LTS statistics 12 in the 15-minute time slice containing the moment under consideration is e.g. 'heavy_incoming' or 'intense_incoming' (typically e.g. between 07.45-08.00 o'clock), the traditional peak hour identification 14 activates the incoming peak traffic mode already on detecting a single peak elevator. During the other traffic types given by LTS statistics, two elevators are required for activation of the incoming peak traffic mode. The traffic types include e.g. normal traffic, incoming peak traffic, outgoing peak traffic and two-way peak traffic.

In another embodiment of FIG. 2, in block 13 a theoretical time interval $t_I$ is calculated for the elevator group. In the case of an incoming peak traffic condition, this means the average time interval between the departures of elevators leaving the lobby floor. The number $n_P$ of passengers gathering on the lobby floor during this time (i.e. the time interval during which passengers gather in a queue waiting for the next arriving elevator) is forecast from the LTS statistics.

$$n_P = t_I \cdot (L_{i,up>,t} + L_{i,dn>,t}), \tag{2}$$

where i is an index of the lobby floor, up> and dn> are indices referring to the traffic components 10 directed away from the floor and t is an index for the current 15-minute time slice. If the forecast number of passengers $n_P$ exceeds the predetermined car load threshold value for traditional peak hour identification, the situation will be interpreted as being a potential peak time. In this case, one peak elevator is sufficient for identification of incoming peak traffic. Otherwise, two peak elevators are required.

The above-described embodiments differ from each other among other things in that, in the latter embodiment, the fuzzy-logic deduction from LTS statistics can be omitted. In both of the above-mentioned embodiments, the traffic type 16 given by STS 15 is used if the traditional traffic detector 14 gives a traffic type other than incoming peak traffic. This selection is made in block 17.

In the identification of a potential peak traffic condition, it is possible to include in the processing, in addition to the 15-minute time window, even the preceding time window (with index 'T−1') and the next time window (with index 'T+1'). In this case, the number of passengers gathering in the elevator queue can be forecast as follows:

$$n_{P1} = t_I \cdot (L_{i,up>,t-1} + L_{i,dn>,t-1}) \cdot \beta$$

$$n_{P2} = t_I \cdot (L_{i,up>,t} + L_{i,dn>,t})$$

$$n_{P3} = t_I \cdot (L_{i,up>,t+1} + L_{i,dn>,t+1}) \cdot \chi, \tag{3}$$

where $\beta$ and $\chi$ are configuration coefficients ($0 \leqq \beta \leqq 1$ and $0 \leqq \chi \leqq 1$). If one of the calculated queue lengths $n_{P1}$, $n_{P2}$ or $n_{P3}$ exceeds the car load threshold value, then the situation can be interpreted as being a potential peak time, from which again a transition to the incoming peak traffic mode is inferred as described above. The consideration is based on anticipating future events by having a lookahead into the next time window. If the next time window represents a peak time according to statistics but the current moment is still within normal traffic time, then it can be assumed to be very probable that a peak elevator detected at the current moment indicates the onset of an incoming peak traffic condition. A corresponding inference can be made from the time window preceding the current moment. If according to the statistics the preceding time window represents an incoming peak traffic condition, then it is very probable that a peak elevator detected at the current moment still means an actual incoming peak traffic situation. The configuration coefficients $\beta$ and $\chi$ can be used to adjust the sensitivity of the 'lookahead'.

In an elevator group there often occur situations where all the elevators in the group are not serving normal passenger traffic. Elevators may be undergoing maintenance, they may be serving special calls or being used for some other special purposes. In these situations, the transport capacity of the rest of the elevator group is reduced and lower-than-normal absolute traffic intensities lead to peak traffic situations. When elevators are missing from the service of normal traffic, the time interval $t_\chi$ increases. Thus, according to (2) and (3), $n_P$, increases, from which it again follows that the car load threshold value is reached sooner. The reduced transport capacity of the elevator group is thus automatically taken into account, because the peak hour identification system transits into a potential peak traffic mode at traffic intensities lower than normal.

FIG. 3 presents an example of a system where the method of the present invention can be used. In this example, the elevator system comprises two elevators 20, 23. The elevators are provided with light cells 22, 25 and car load weighing devices 21, 24 for real-time monitoring of the numbers of passengers. The data regarding the numbers of passengers are input to the control logic 26, where the movements of the elevators in the elevator system are controlled. The statistical data regarding the numbers of passengers transported by the elevators are stored in a database 27. In addition to the above, the control logic is also used to make a decision as to which is the most typical traffic type for the moment under consideration obtainable from the statistics. Furthermore, on the basis of the method of the present invention, the control logic makes a decision regarding the prevailing traffic type and controls the elevators in accordance with the decision thus made. In other words, the control logic interprets the prevailing traffic type as a peak traffic condition if the car load threshold value for peak hour identification is exceeded in at least one elevator and the collected statistical data for the current time window indicates a peak traffic situation. In practice, the control logic consists of e.g. a computer in combination with a computer program implementing the decisions regarding traffic type and the control of the elevators.

In an embodiment of FIG. 3, the system comprises first determining means for determining weighting values for the entrance floors on the basis of statistical data according to the numbers of users and control means for directing the elevators to the entrance floors during an incoming peak traffic situation in accordance with the weighting values thus determined.

In an embodiment of FIG. 3, the system comprises second determining means for determining the number of simultaneous peak elevators that is required for identification of a real-time peak traffic situation.

In an embodiment of FIG. 3, the system comprises third determining means for determining the length of the time window to be used in the statistical data, calculating means for calculating the numbers of passengers arriving to and leaving a floor within the determined time window in relation to the time of the day, summing means for adding the said statistical data collected for the diurnal cycle under consideration and comprising the numbers of passengers to existing statistical data, weighted with a predetermined update coefficient, and first deducing means for deducing the most probable traffic type prevailing during each time window on the basis of said statistical data.

In an embodiment of FIG. 3, the system comprises first identifying means for identifying a potential peak traffic situation if the aforesaid statistical data indicates a peak traffic situation and second deducing means 26 for interpreting a potential peak traffic situation as an actual peak traffic condition if the number of peak elevators detected during the potential peak traffic situation is at least one but less than the aforesaid simultaneous number of peak elevators.

In an embodiment of FIG. 3, the system comprises time interval determining means for calculating the average time interval between the departures of elevators from the entrance floor, estimating means for forecasting the number of passengers gathering in an elevator queue on the basis of statistical data during the aforesaid time interval, first identifying means for identifying a potential peak traffic situation when the aforesaid forecast number of passengers exceeds the car load threshold value for peak hour identification and second deducing means for inferring a potential peak traffic situation as an actual peak traffic situation if the number of peak elevators detected during the potential peak traffic situation is at least one but less than the aforesaid simultaneous number of peak elevators.

In an embodiment of FIG. 3, the second deducing means has been arranged to require at least the aforesaid number of peak elevators outside a potential peak traffic situation for identification of an actual peak traffic situation.

In an embodiment of FIG. 3, the system comprises fourth determining means for determining weighting coefficients for one or more time windows preceding and following the time window used in statistical data, estimating means for forecasting in the aforesaid manner the number of passengers accumulated in addition to the time window for the moment under consideration for all the aforesaid time windows by using the weighting coefficients determined, second identifying means for identifying a potential peak traffic situation if at least one of the aforesaid forecast numbers of passengers exceeds the car load threshold value for peak hour identification and second deducing means for inferring a potential peak traffic situation as an actual peak traffic situation if the number of peak elevators detected during the potential peak traffic. situation is at least one but less than the aforesaid simultaneous number of peak elevators.

The means described above are implemented using e.g. a control logic 26. The means can also be implemented as a combination of software and hardware.

A peak hour identification principle operating in the above-described manner can be compared to automatic parking of elevators. Typically, the parking floors are determined manually at the time of delivery of the elevator or they are configured on site. In automatic parking, the building is divided on the basis of LTS statistics into parking zones based on the traffic components directed away from the floors. Within each zone, the floor with the most intense traffic away from the floor is selected as the main parking floor. The zones again are defined in such manner that the intensity of the total traffic away from the floors of different zones is equal in each zone. Thus, the floors with quiet traffic form higher zones as compared to the floors with intense traffic. The actual dispatching of the elevators to the parking floors is done in the same way as in the case of manually defined floors.

In a manner corresponding to the above-described automatic parking, wherein statistics are used to determine where the elevators should preferably be parked and the actual parking is carried out by a traditional method, in peak hour identification the statistics are read in block 13 to see when a potential incoming peak traffic situation is to be expected and the actual incoming peak traffic condition is identified by a traditional method in block 14. Thus, the statistics have a role that is the most natural to them. They serve as an aid in actual decision-making, which again works in accordance with information on occurrences actually taking place in the system at the present moment.

The invention is not limited to the embodiment examples described above; instead, many variations are possible within the scope of the inventive concept defined in the claims.

The invention claimed is:

1. Method for identifying an incoming peak traffic condition in an elevator system, the method comprising the steps of:

monitoring in real-time peak hour identification of the elevator system the number of car calls and the car load of an elevator taking in passengers in a lobby area;

determining a car load threshold value, on the basis of which an elevator is identified as a peak elevator if the car load exceeds the car load threshold value;

defining a threshold value of car calls, on the basis of which a peak elevator is identified if the number of car calls to floors outside a lobby area exceeds the threshold value of car calls;

collecting statistical data regarding the numbers of passengers arriving to a floor in the elevator system and those leaving the floor during predetermined time windows; and selecting the prevailing traffic type as an incoming peak traffic condition if at least one peak elevator has been detected and the collected statistical data for the current time window indicates an incoming peak traffic condition.

2. Method according to claim 1, further comprising the step of:

determining the number of simultaneous peak elevators that is required for identification of a real-time peak traffic situation.

3. Method according to claim 2, wherein the aforesaid number of simultaneous peak elevators is two.

4. Method according to claim 2, further comprising the steps of:

identifying a potential peak traffic situation if the said statistical data indicates a peak traffic situation; and interpreting the potential peak traffic situation as an actual peak traffic situation if the number of peak elevators detected during the potential peak traffic situation is at least one but less than the aforesaid simultaneous number of peak elevators.

5. Method according to claim 2, further comprising the steps of:

calculating the said time interval between departures of elevators from the entrance floor;

forecasting on the basis of the statistical data the numbers of passengers gathering in the elevator queue during the aforesaid time interval;

identifying a potential peak traffic situation when the aforesaid forecast number of passengers exceeds the car load threshold value for peak hour identification; and inferring the potential peak traffic situation as an actual peak traffic situation if the number of peak elevators detected during the potential peak traffic situation is at least one but less than the aforesaid simultaneous number of peak elevators.

6. Method according to claim 4 or 5, further comprising the step of:

requiring at least the said simultaneous number of peak elevators outside a potential peak traffic situation for identification of an actual potential peak traffic situation.

7. Method according to claim 5, wherein:

weighting coefficients are determined for one or more time windows preceding and following the time window used in the statistical data;

the number of passengers gathering is forecast in the aforesaid manner, in addition to the time window for the moment under consideration, for all the aforesaid time windows by using the weighting coefficients determined;

a potential peak traffic situation is identified if at least one of the said forecast numbers of passengers exceeds the car load threshold value for peak hour identification; and the potential peak traffic situation is inferred as an actual peak traffic situation if at least one but fewer than the aforesaid simultaneous number of peak elevators are detected during the potential peak traffic situation.

8. Method according to claim 1, further comprising the steps of:

determining weighting values for the entrance floors on the basis of the statistical data and in accordance with the number of passengers; and directing the elevators during an incoming peak traffic situation to the entrance floors according to the weighting values thus determined.

9. Method according to claim 1, further comprising the steps of:

defining the length of the time window to be used in the statistical data;

calculating the numbers of passengers arriving to and leaving the floor within the defined time window in relation to the time of the day;

adding the statistical data regarding the aforesaid numbers of passengers collected for the diurnal cycle under consideration to the existing statistical data, weighted by a predetermined updating coefficient; and inferring from the said statistical data the most probable traffic type prevailing during each time window.

10. A computer readable medium having stored thereon a computer program product for identification of an incoming peak traffic situation in an elevator system, the computer program product causing a processor to execute the steps of:

monitoring in real-time peak hour identification of the elevator system the number of car calls and the car load of an elevator taking in passengers in a lobby area;

determining a car load threshold value, on the basis of which the elevator is identified as a peak elevator if the car load exceeds the car load threshold value;

defining a threshold value of car calls, on the basis of which a peak elevator is identified if the number of car calls to floors outside the lobby area exceeds the threshold value of car calls;

collecting statistical data regarding the numbers of passengers arriving to a floor in the elevator system and those leaving the floor during predetermined time windows; and selecting the prevailing traffic type as an incoming peak traffic condition if at least one peak elevator has been detected and the collected statistical data for the current time window indicates an incoming peak traffic condition.

11. The computer readable medium according to claim 10, further causing a processor to execute the step of:

determining the number of simultaneous peak elevators that is required for the identification of a real-time peak traffic situation.

12. The computer readable medium according to claim 11, further causing a processor to execute the step of:

selecting the aforesaid number of simultaneous peak elevators to be two.

13. The computer readable medium according to claim 11, further causing a processor to execute the steps of:

identifying a potential peak traffic situation if the said statistical data indicates a peak traffic situation; and interpreting the potential peak traffic situation as an actual peak traffic situation if the number of peak elevators detected during the potential peak traffic situation is at least one but less than the aforesaid simultaneous number of peak elevators.

14. The computer readable medium according to claim 13, further causing a processor to execute the step of:

requiring at least the said simultaneous number of peak elevators outside a potential peak traffic situation for identification of an actual potential peak traffic situation.

15. The computer readable medium according to claim 11, further causing a processor to execute the steps of:

calculating the said time interval between departures of elevators from the entrance floor;

forecasting on the basis of the statistical data the numbers of passengers gathering in the elevator queue during the aforesaid time interval;

identifying a potential peak traffic situation when the aforesaid forecast number of passengers exceeds the car load threshold value for peak hour identification; and inferring the potential peak traffic situation as an actual peak traffic situation if the number of peak elevators detected during the potential peak traffic situation is at least one but less than the aforesaid simultaneous number of peak elevators.

16. The computer readable medium according to claim 15, wherein:

weighting coefficients are determined for one or more time windows preceding and following the time window used in the statistical data;

the number of passengers gathering is forecast in the aforesaid manner, in addition to the time window for the moment under consideration, for all the aforesaid time windows by using the weighting coefficients determined;

a potential peak traffic situation is identified if at least one of the said forecast numbers of passengers exceeds the car load threshold value for peak hour identification; and the potential peak traffic situation is inferred as an actual peak traffic situation if at least one but fewer than the aforesaid simultaneous number of peak elevators are detected during the potential peak traffic situation.

17. The computer readable medium according to claim 10, further causing a processor to execute the steps of:

determining weighting values for the entrance floors on the basis of the statistical data and in accordance with the number of passengers; and directing the elevators during an incoming peak traffic situation to the entrance floors according to the weighting values thus determined.

18. The computer readable medium according to claim 10, further causing a processor to execute the steps of:

defining the length of the time window to be used in the statistical data;

calculating the numbers of passengers arriving to and leaving the floor within the defined time window in relation to the time of the day;

adding the statistical data regarding the aforesaid numbers of passengers collected for the diurnal cycle under consideration to the existing statistical data, weighted by a predetermined updating coefficient; and inferring from the said statistical data the most probable traffic type prevailing during each time window.

19. System for identifying an incoming peak traffic situation in an elevator system, said system comprising:

at least one elevator;

a car load weighing device for calculating the car load of elevator passengers for the identification of a peak elevator;

an elevator door light cell for counting the number of passengers entering the elevator and the number of passengers leaving the elevator;

a control logic for recognizing car calls for identification of a peak elevator, for management of traffic flow and control of the elevator system; and a database for the collection of statistical data, said statistical data comprising the numbers of passengers arriving to and leaving the floor during predetermined time windows, wherein said control logic has been arranged to interpret the prevailing traffic type as an incoming peak traffic condition if at least one peak elevator has been detected and the statistical data collected indicates an incoming peak traffic condition.

20. System according to claim 19, wherein said control logic is further configured to determine the number of simultaneous peak elevators required for identification of a real-time peak traffic situation.

21. System according to claim 20, wherein said number of simultaneous peak elevators is two.

22. System according to claim 20, wherein said control logic is further configured to:

identify a potential peak traffic situation if the aforesaid statistical data indicates a peak traffic situation; and interpret a potential peak traffic situation as an actual peak traffic condition if the number of peak elevators detected during the potential peak traffic situation is at least one but less than the aforesaid simultaneous number of peak elevators.

23. System according to claim 22, wherein said control logic is configured to require at least the aforesaid number of peak elevators outside a potential peak traffic situation for identification of an actual peak traffic situation.

24. System according to claim 20, wherein said control logic is further configured to:

calculate the average time interval between departures of elevators from the entrance floor;

forecast the number of passengers gathering in an elevator queue on the basis of statistical data during the aforesaid time interval;

identify a potential peak traffic situation when the aforesaid forecast number of passengers exceeds the car load threshold value for peak hour identification; and infer a potential peak traffic situation as an actual peak traffic situation if the number of peak elevators detected during the potential peak traffic situation is at least one but less than the aforesaid simultaneous number of peak elevators.

25. System according to claim 24, wherein said control logic is further configured to:

determine weighting coefficients for one or more time windows preceding and following the time window used in the statistical data;

forecast in the aforesaid manner the number of passengers accumulated in addition to the time window for the moment under consideration for all the aforesaid time windows by using the weighting coefficients determined;

identify a potential peak traffic situation if at least one of the aforesaid forecast numbers of passengers exceeds the car load threshold value for peak hour identification; and infer a potential peak traffic situation as an actual peak traffic situation if the number of peak elevators detected during the potential peak traffic situation is at least one but less than the aforesaid simultaneous number of peak elevators.

26. System according to claim 19, wherein said control logic is further configured to:

determine weighting values for the entrance floors on the basis of the statistical data according to the number of users; and direct the elevators to the entrance floors during an incoming peak traffic situation in accordance with the weighting values determined.

27. System according to claim 19, wherein said control logic is further configured to:

determine the length of the time window used in the statistical data;

calculate the numbers of passengers arriving to and leaving the floor within a defined time window in relation to the time of the day;

add the said statistical data collected for the diurnal cycle under consideration and comprising the numbers of passengers to the existing statistical data, weighted with a predetermined update coefficient; and deduce the most probable traffic type prevailing during each time window on the basis of said statistical data.

* * * * *